US011459171B2

(12) United States Patent
Reeb et al.

(10) Patent No.: US 11,459,171 B2
(45) Date of Patent: Oct. 4, 2022

(54) LOCKING DEVICE

(71) Applicant: Serio-Us Industries, Inc., Baltimore, MD (US)

(72) Inventors: David L. Reeb, Sykesville, MD (US); James L. Martin, II, Gambrills, MD (US)

(73) Assignee: Serio-Us Industries, Inc., Baltimore, MD (US)

( * ) Notice: Subject to any disclaimer, the term of this patent is extended or adjusted under 35 U.S.C. 154(b) by 1031 days.

(21) Appl. No.: 16/154,904

(22) Filed: Oct. 9, 2018

(65) Prior Publication Data

US 2019/0106278 A1 Apr. 11, 2019

Related U.S. Application Data

(60) Provisional application No. 62/569,676, filed on Oct. 9, 2017.

(51) Int. Cl.
*B65F 1/16* (2006.01)
*B65F 1/02* (2006.01)

(52) U.S. Cl.
CPC ..... *B65F 1/1615* (2013.01); *B65F 1/02* (2013.01)

(58) Field of Classification Search
CPC ..... B65F 1/02; B65F 1/1615; E05B 67/365; E05B 2015/107; E05B 2015/0265; E05B 15/006; Y10T 70/7751; Y10T 70/5566; Y10T 70/5558; Y10T 70/5533; Y10T 70/5549; Y10T 70/40
USPC ..... 220/315
See application file for complete search history.

(56) References Cited

U.S. PATENT DOCUMENTS

| | | | |
|---|---|---|---|
| 2009/0066092 | A1 | 3/2009 | Reeb |
| 2015/0314957 | A1 | 11/2015 | Reeb |
| 2016/0355334 | A1 | 12/2016 | Reeb et al. |
| 2017/0190509 | A1 | 7/2017 | Reeb et al. |
| 2017/0320665 | A1 | 11/2017 | Reeb et al. |

*Primary Examiner* — Anthony D Stashick
*Assistant Examiner* — James M Van Buskirk
(74) *Attorney, Agent, or Firm* — Berenato & White, LLC

(57) ABSTRACT

The present invention generally relates to waste containers and, more particularly, relates to a locking device for waste containers. The locking device is gravity actuated to an opened position on tilting of the container for dumping. The locking device allows the lid of the container, when the container is in an upright position, to be locked to prevent unauthorized access to the container. When the container is tilted from the upright position, e.g. to empty the contents of the container, the locking device is gravity actuated to allow the lid to open.

24 Claims, 14 Drawing Sheets

LOCKING DEVICE

CROSS-REFERENCE TO RELATED APPLICATIONS AND CLAIM TO PRIORITY

This application claims the priority of U.S. Provisional Patent Application No. 62/569,676, filed Oct. 9, 2017, which is incorporated herein by reference.

FIELD OF THE INVENTION

The present invention generally relates to waste containers and, more particularly, relates to a locking device for waste containers. The locking device is gravity actuated to an opened position on tilting of the container for dumping.

BACKGROUND OF THE INVENTION

As is well known, waste containers, such as refuse containers for use in residential and industrial applications, typically include a container supported on a base structure. With the advent of mechanized trash removal, there have been created a number of large sized trash bins or dumpsters. These containers usually comprise a block-shaped or pyramid-shaped container with a hinged lid attached to one side thereof. The container further includes attachments for accommodating various lifting mechanisms of a trash removal vehicle. Each container is lifted by the lifting mechanism of the trash removal vehicle and pivoted in some fashion, so that the hinged top of the container opens and the trash contained therein may be emptied into the vehicle. The container is then returned to a position on the ground, and the hinged lid closes on top of the container. Many of these large trash receptacles are rented from a trash removal service. These receptacles are not provided free of charge, and consequently their frequent emptying and service can become a considerable expense. This expense is increased when unauthorized users deposit trash therein. This unauthorized use necessitates a more frequent emptying of the container, and of course the unauthorized user does not contribute to the increased expense attributable to the need for more frequent dumping.

In order to reduce the added expense that comes from unauthorized use, the dumpster may be locked. While conventional chains and padlocks reduce unauthorized dumpster use, they also add to operating expenses because the driver of the truck emptying the dumpster must get out of the truck to unlock the padlock on the dumpster and then reverse the process after emptying. For decades, companies have been developing and marketing dumpster locking mechanisms that open automatically when the dumpster is lifted and inverted to dump the trash into the truck. With such as automatic lock, the driver is not required to leave the truck, which saves the trash company hundreds of dollars each year.

Conventional automatic locks are typically bulky, expensive and difficult to mount to multiple containers. Since containers come in a variety of shapes and sizes, it is important that the locking device be sized and shaped to be retrofit onto a variety of existing containers. Moreover, the locking device must be able to withstand the rigors of everyday, outdoor use in the waste environment.

Therefore, there exists a need for an automatic locking device that improves upon prior automatic locking devices and solves the problems inherent in known automatic locking devices.

SUMMARY OF THE INVENTION

A first aspect of the invention provides a locking device for a container having a hinged lid. The container has a hinged lid that is movable between an upright storing position and a tilted dumping position for emptying the container. The locking device allows the lid of the container, when the container is in an upright position, to be locked to prevent unauthorized access to the container. When the container is tilted from the upright position, e.g. to empty the contents of the container, the locking device is gravity actuated to allow the lid to open.

The locking device contains a base unit and a pivotable unit pivotally mounted to the base unit. The base unit is adapted to be fixed to the container and contains a locking mechanism therein. The locking mechanism contains a sliding member, a rolling member, a pivot lever, a biasing member, and a connecting member. The connecting member allows the locking mechanism to be connected to the pivotable unit. The rolling member is affected by gravity to be in the blocked position when the container is upright and in the unblocked position when the container is tilted past a predetermined angle. In the blocked position, the sliding member is blocked from sliding forwardly to allow the locking device to be placed in the opened position. In the unblocked position, the sliding member may slide forwardly to place the locking device in the opened position. The biasing member and the pivot lever function to keep the pivotable unit away from the trash stream when the container is in the dumping position, and to place the locking unit back into the close position when the container is righted after dumping operation. Keeping the pivotable unit from the trash stream is important to prevent damage to components of the locking device due to impact with heavy trash items.

A second aspect of the invention provides a container having a hinged lid over an opening thereof and a locking device mounted to a first side wall of the container. A support member is mounted to a second side wall, opposing the first side wall. The support member has a pivoting arm pivotally mounted thereto. A locking bar connects the pivoting unit and the pivoting arm. In the closed position, the locking bar is positioned over the hinged lid to prevent it from opening. In the open position, the locking bar is spaced away from the hinged lid to allow it to be lifted away from container, thereby opening the container.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. The objects and advantages of the invention will become apparent from a study of the following specification when viewed in light of the accompanying drawings, in which like elements are given the same or analogous reference numerals and wherein.

DETAILED DESCRIPTION OF THE PREFERRED EMBODIMENT(S)

Figure 1:
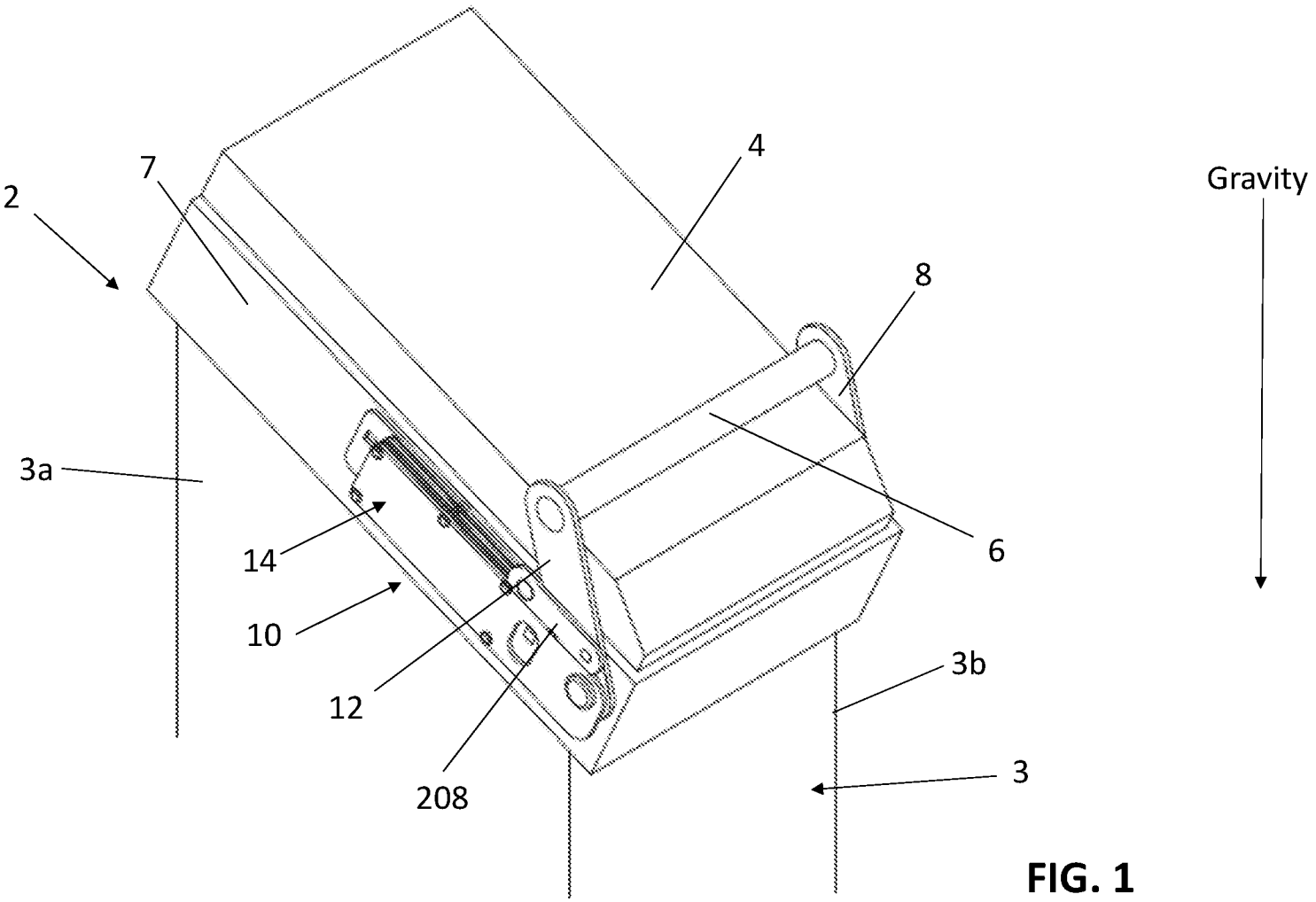
FIG. 1 is a fragmentary perspective view from a side of a waste container in an upright position with a locking device in a close position.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

Figure 3:
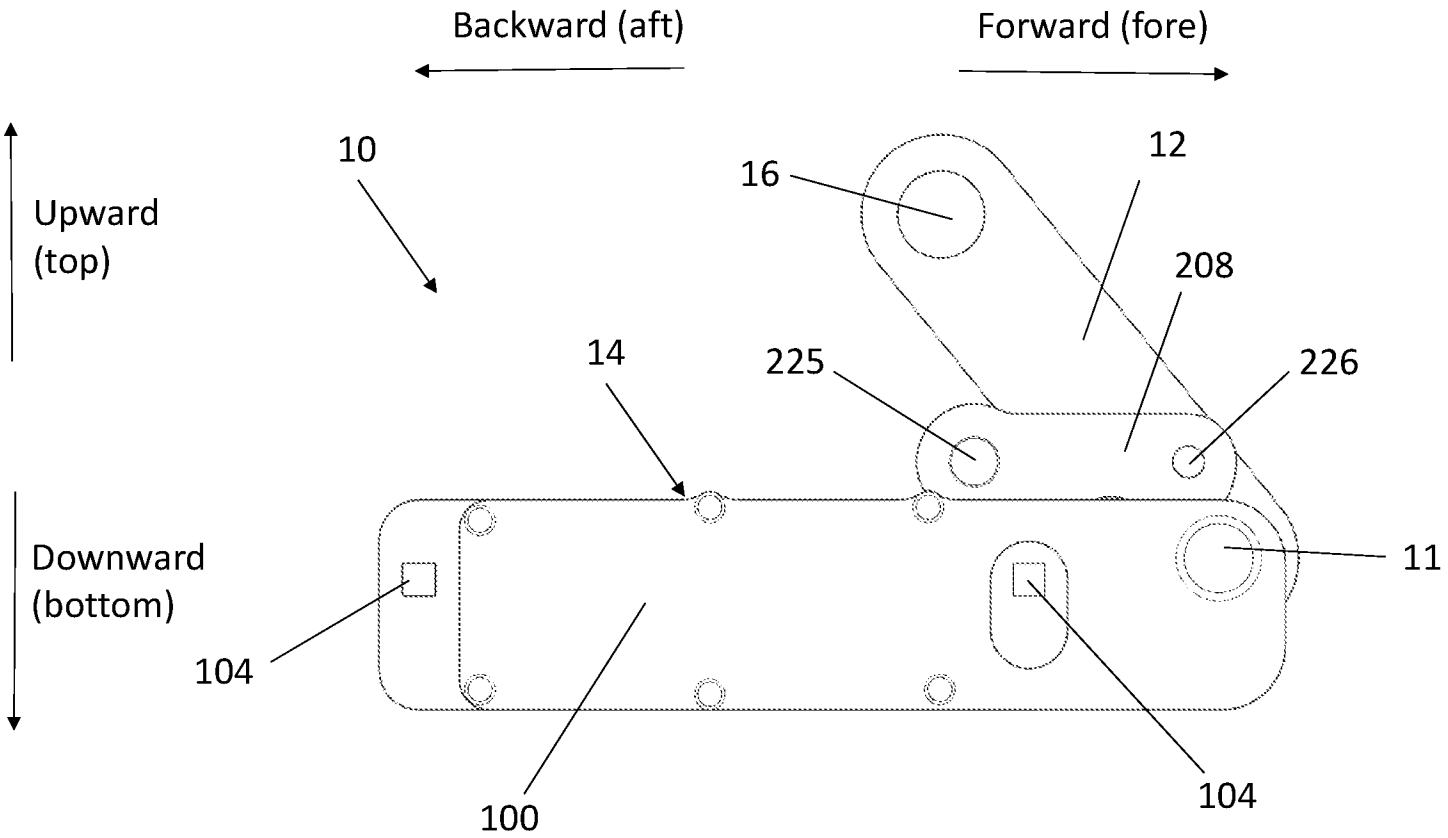
FIG. 3 is a side view of the locking device from the outer side.
Figure 4:
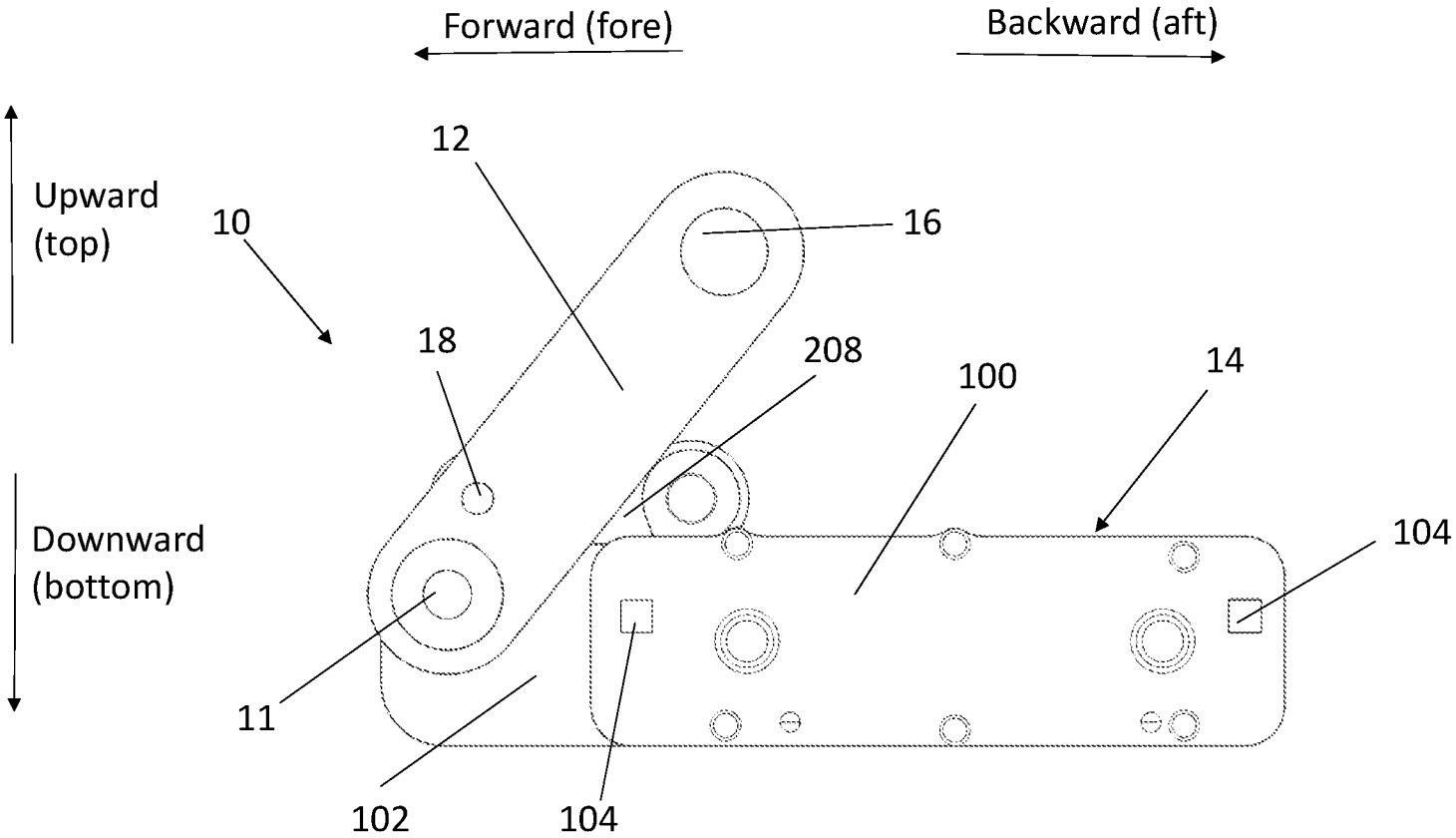
FIG. 4 is a side view of the locking device from the inner side.

This description of exemplary embodiments is intended to be read in connection with the accompanying drawings, which are to be considered part of the entire written description. In the description, relative terms such as "horizontal," "vertical," "up," "down," "upper", "lower", "right", "left", "top", "bottom", "forward", and "backward" as well as derivatives thereof (e.g., "horizontally," "downwardly," "upwardly," etc.) should be construed to refer to the orientation as then described or as shown in FIGS. 3 and 4. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. Additionally, the word "a" and "an" as used in the claims means "at least one" and the word "two" as used in the claims means "at least two".

Figure 2:
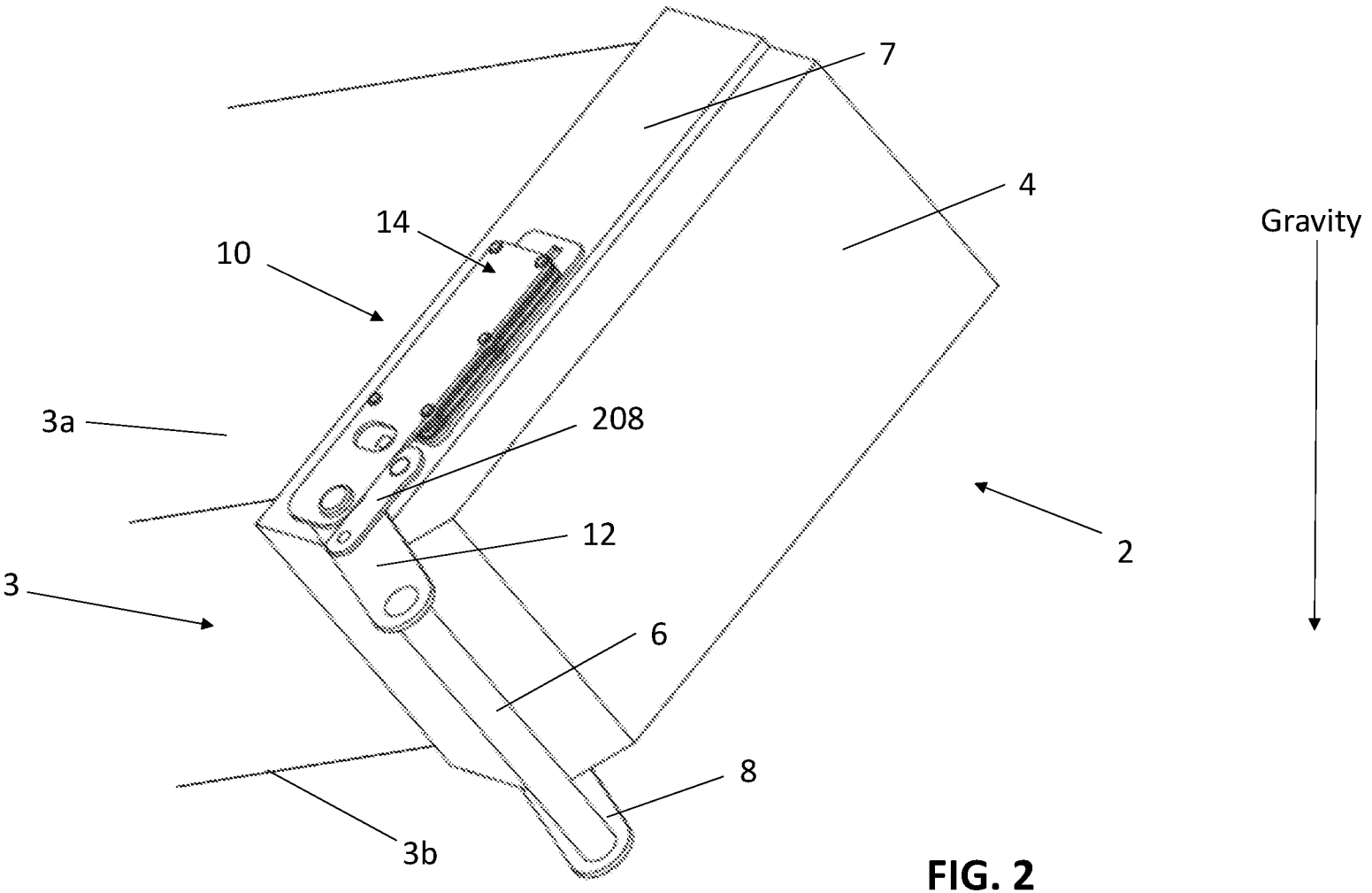
FIG. 2 is a fragmentary perspective view of the waste container of FIG. 1 in a tilted position with the locking device in the open position.

FIGS. 1-2 illustrate a container 2, such as a trash collector or dumpster, including a container body 3, at least one hinged lid 4 pivotally mounted thereto, a safety locking device 10 and a locking bar 6 extending across the top of the waste container 2. The locking device 10 is provided for locking and unlocking the hinged lid 4 of the container 2 to prevent unauthorized access to it. The locking bar 6 extends between the locking device 10 at one end and a pivoting arm 8 at the other end of container 3. The locking device 10 is preferably mounted to a side wall 3*a* of the container body 3 (herein defined as a lock side of the container body 3), while the pivoting arm 8 is preferably pivotally mounted to the opposite side wall 3*b* thereof (herein defined as a dummy side of the container body 3). Although the drawings show the lock side as the right side of the container body 3 and the dummy side (for mounting a support member) as the left side of the container body 3, the reverse is also within the scope of the present invention, where the lock side is the left side of the container body 3 and the dummy side is the right side of the container body 3. The lock side and the dummy side may be located anywhere on the container as long as the locking bar 6 may be positioned over the lid 4 to block the opening of the container 2, and moved to be spaced from the lid 4 to allow opening of the container 2. The locking device 10 may be mounted to a flanged lip 7 of the container body 3 or directly to a side of the container body 3.

The container 2, as illustrated in FIGS. 1-2, is generally an industrial-type dumpster used for retaining, storing, and eventually disposing of refuse (waste). The container 2 may be tilted or otherwise pivoted from an upright (or on-the-ground) position (wherein the waste container 2 is sitting generally horizontally on the ground) (shown in FIG. 1) to a tilted or dumping position (shown in FIG. 2).

As best shown in FIGS. 1-4, the locking device 10 contains a base unit 14 and a pivotable unit 12 pivotally coupled to the base unit 14. The pivotable unit 12 is preferably a bar having one end that is pivotally coupled to the base unit 14 by a coupling 11, e.g. by a rivet or a nut/bolt. The coupling 11 allows the pivotable unit 12 to rotate relative to the base unit 14 by pivoting around the coupling 11. The other end of the pivotable unit 12 preferably contains a hole 16 (e.g. FIG. 3) for coupling to the locking bar 6, when the locking device 10 is mounted on the waste container 2. Preferably, the locking bar 6 is fixed to the hole 16 of the pivotable unit 12 and extends approximately perpendicularly to the plane of the pivotable unit 12.

The base unit 14 includes a locking mechanism that is mounted in the interior of a housing 100. The housing 100 contains a forward end containing a tab 102 (as best shown in FIG. 4) for coupling to the pivotable unit 12. The housing 100 may also contain throughholes 104 for attaching the base unit 14 to the container 2 with mechanical fasteners, such as screws, nuts/bolts, or rivets.

Figure 5:
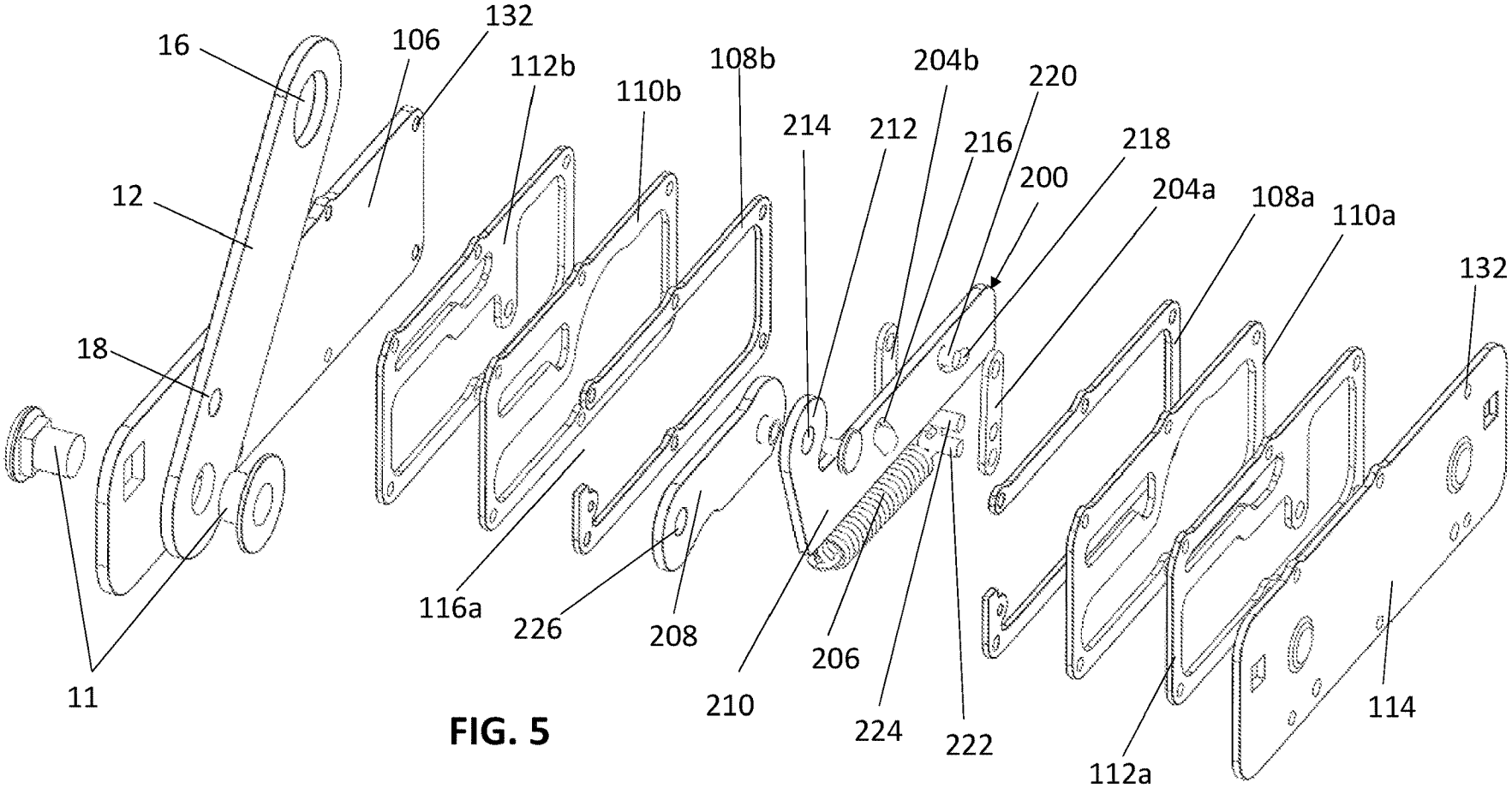
FIG. 5 is an exploded view of the locking device.
Figure 6:
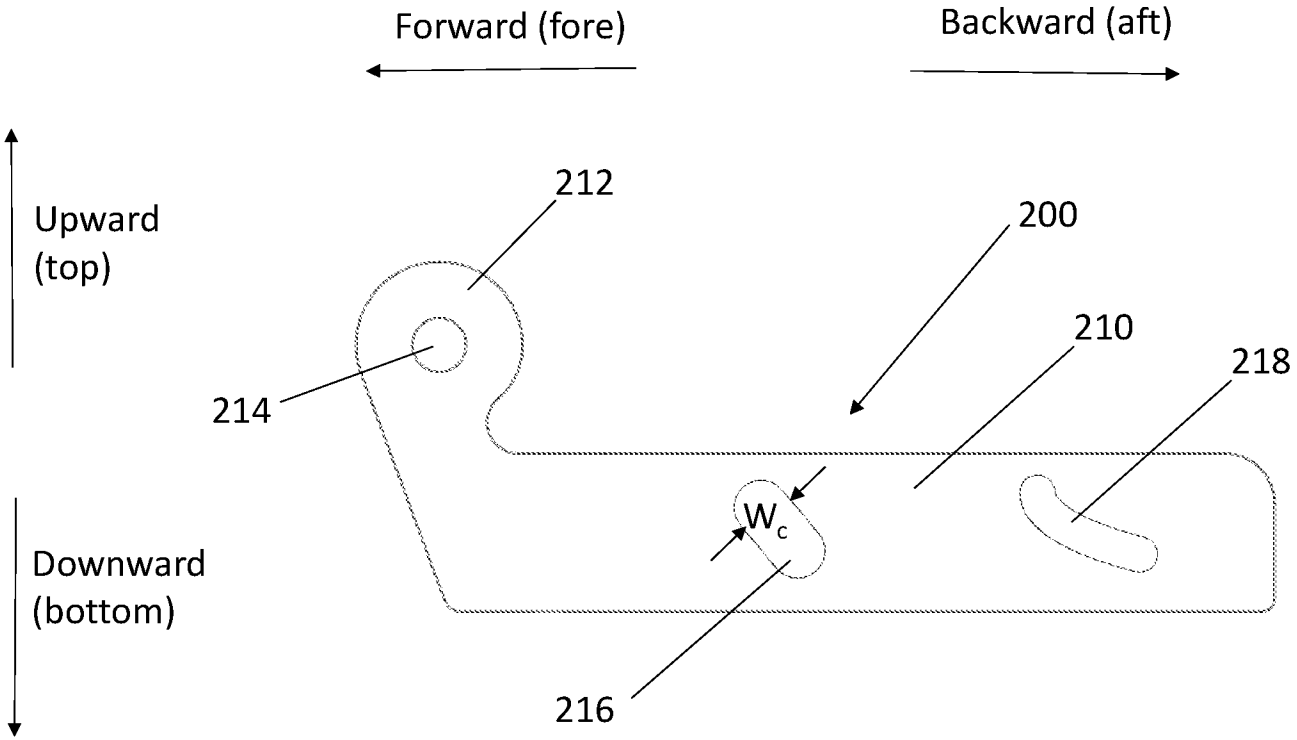
FIG. 6 is a side view of the sliding member.
Figure 8:
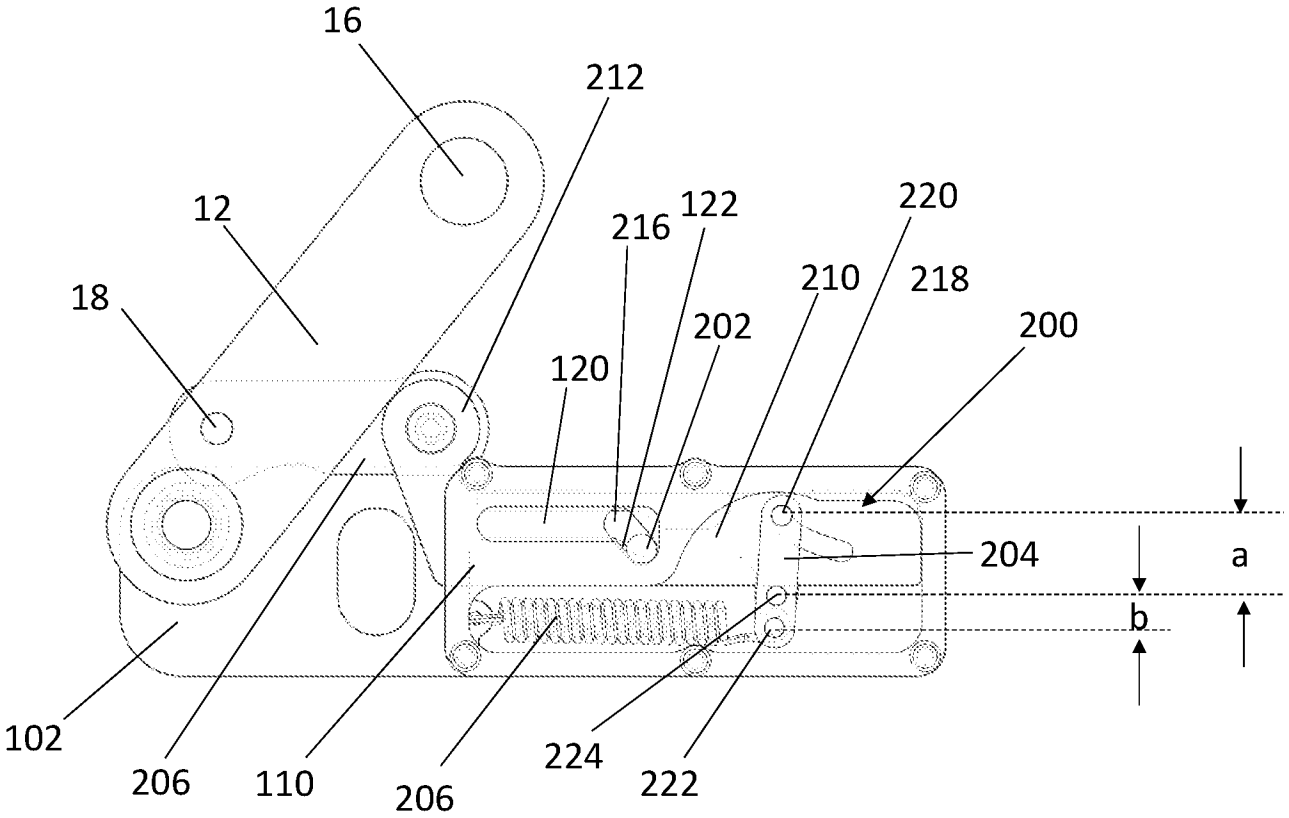
FIG. 8 is a side view of the locking device from the inner side (with the anchor and inner plates removed)
Figure 13:
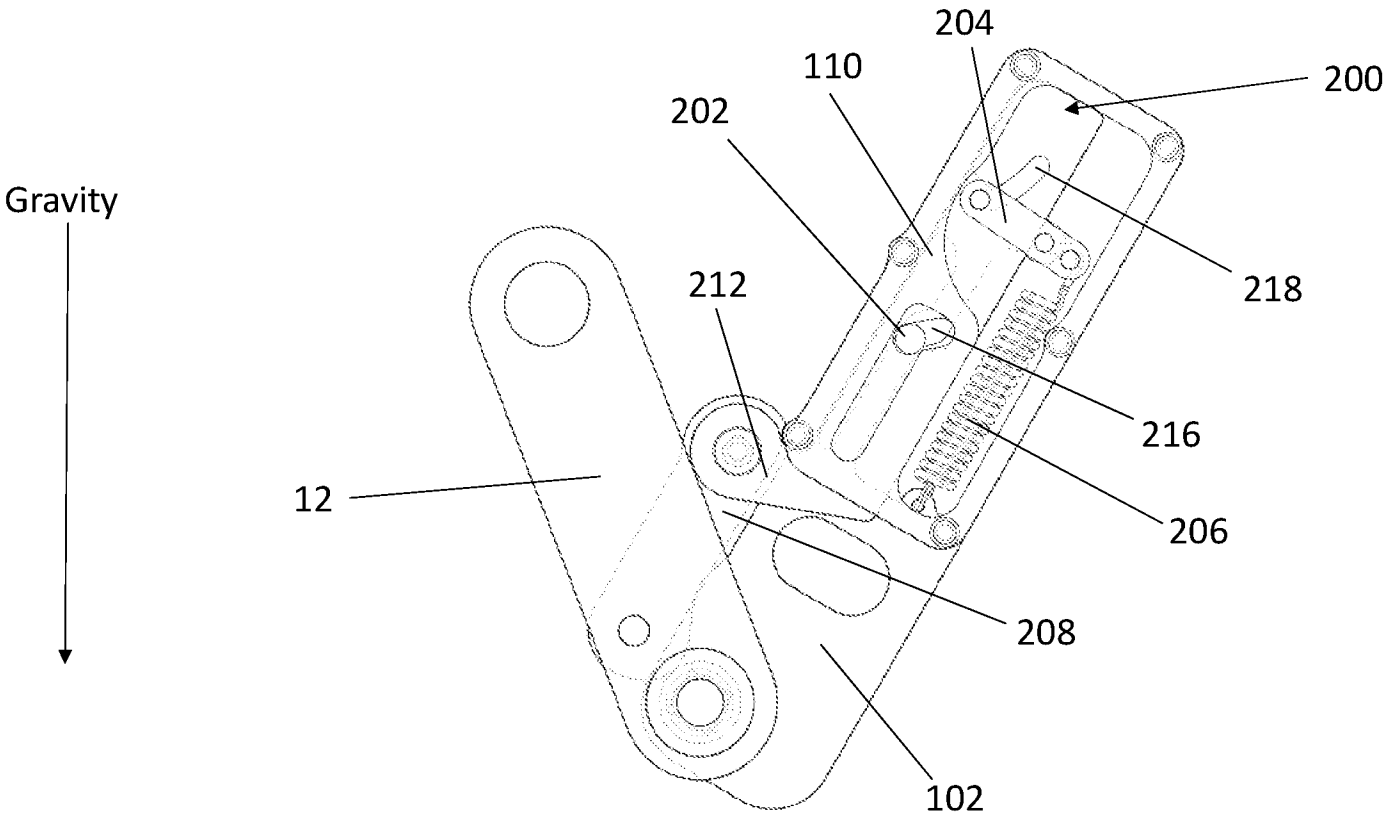
FIG. 13 is a side view of the locking device from the inner side (with the anchor and inner plates removed) while being tilted.

The locking mechanism, as best shown in FIGS. 5 and 8, contains a sliding member 200, a rolling member 202, pivot levers 204*a* and 204*b*, a biasing member 206, and a connecting member 208. The sliding member 200 is a substantially flat plate mounted inside the housing 100 and slidable in a fore/aft direction relative to the housing 100. As best shown in FIG. 6, the sliding member 200 contains a main body 210 and a neck portion 212 extending from the main body 210, preferably at the forward end. The neck portion 212 preferably contains a hole 214 for pivotally coupling to a back end of the connecting member 208 with a mechanical fastener, such as a rivet or nut/bolt. The coupling of the neck portion 212 to the connecting member 208 allows the connecting member 208 to freely rotate around that coupling. The main body 210 contains a first slot 216 for receiving the rolling member 202 therein. The first slot 216 is an angularly disposed in the main body 210 for receiving the rolling member 202. The slot 216 is preferably angled at about 30 to 60° relative to the sliding direction of the sliding member 200. The angle is such that, when the locking device 10 is in its upright and locked position, the rolling member 202 is pulled by gravity to the bottom of the first slot 216 (see FIG. 8); and when the locking device 10 is sufficiently tipped forward (tipped forward at a predetermined angle), gravity pulls the rolling member 202 to the top of the first slot 216 (see FIG. 13).

The rolling member 202 may be in the form of a spherical ball. Alternatively, the rolling member 202 may be in the form of a cylindrical disc, capable of rolling within the first slot 216. It will be appreciated that the diameter of the rolling member 202 is the same or slightly smaller than a width We of the slot 216 (as best shown in FIGS. 6 and 8), such that the rolling member 202 can roll freely within the slot 216. As explained below, when the rolling member 202 is located at the bottom of the first slot 216, it cooperates with other parts within the housing 100 to block the sliding member 200 from sliding forwardly (the blocked position); and when the rolling member 202 is located at the top of the first slot 216, the sliding member 200 may freely slides in the forward direction (the unblocked position).

The main body 210, as best shown in FIGS. 5-6, also contains a second slot 218, preferably toward the back of the sliding member 200 in relation to the first slot 216, for coupling of the pivot levers 204*a* and 204*b* thereto. Although the drawings illustrate two pivot levers 204*a* and 204*b*, only one pivot lever is needed for the present invention. Henceforth, only one pivot lever is described and referred to as 204, although two pivot levers, one on each side of the sliding member 200, may also be used. The second slot 218 preferably has an upward crescent shape and is angularly disposed in the main body 210 for coupling with the pivot lever 204. A line connecting the ends of the second slot 218 is preferably angled at about 1 to about 89° relative to the sliding direction of the sliding member 200, more preferably about 10 to about 70°, most preferably about 20 to about 50°. A top shaft 220, passing through the second slot 218 and a hole at a top end of the pivot lever 204, connects the pivot lever 204 to the sliding member 200. The top shaft 220 is slidable within the second slot 218, as best shown in FIG. 8. When the sliding member 200 is in its aftmost position, the pivot lever 204 is preferably in an approximately vertical (top/bottom direction) position. The pivot lever 204 is coupled to the biasing member 206 at its bottom end, preferably via a bottom shaft 222, which passes through a hole at a bottom end of the pivot lever 204. The biasing member 206 preferably is a spring that biases the bottom end of the pivot lever 204 in the forward direction. The pivot lever 204 pivots around a pivot shaft 224, which preferably passes through a middle hole (locating between the top and bottom holes) on the pivot lever 204. The pivot shaft 224 is fixed relative to the housing 100 and allows the pivot lever 204 to pivot thereabout. The pivot shaft 224 preferably supports the bottom of the sliding member 200 and allows the sliding member 200 to slide thereon. As best illustrated in FIG. 8, the distance a between the top shaft 220 and the pivot shaft 224 is preferably greater than the distance b between the bottom shaft 222 and the pivot shaft. Thus, the a:b ratio is preferably greater than 1, more preferably about 1.3:1 to about 5:1, most preferably about 1.5:1 to about 3:1. The preferred ranges given for the a:b ratio are based upon practical considerations, but a high ratio is most desirable.

As best shown in FIGS. 3 and 5, the connecting member 208 contains a hole 225 on the aft end for coupling to the neck portion 212 of the sliding member 200, as discussed above. The forward end of the connecting member contains a hole 226 matching a hole 18 on the pivotable member 12. A pad lock may engage both holes 226 and 18 to lock the pivotable member 12 to the locking mechanism to prevent unauthorized access to the interior of the container 2. As shown in FIG. 5, the connecting member 208 may be formed as a flat bar; however, the connecting member 208 may also be a metal rod or a stiff member of various shapes.

As best illustrated in FIG. 5, the housing 100 is preferably made up of several substantially flat plates which are assembled to form the housing 100. The plates may be assembled together with mechanical fasteners, such as rivets, bolts/nuts, or screws, without requiring welds. The plates include an outer plate 106, frame plates 108*a* and 108*b*, blocking plates 110*a* and 110*b*, anchor plates 112*a* and 112*b*, and an inner plate 114. The outer plate 106 is the outermost plate farthest from the container 2 when the locking device 10 is mounted on the container 2. The pivotable member 12 is mounted to the end tab 102 of the outer plate 106. The inner plate 114 is the innermost plate locating adjacent to the container 2 when the locking device 10 is mounted on the container 2. As used herein, "inner," "inner side," or the like refers to the side of the locking device that is closest to the container 2 when the locking device 10 is mounted on the container 2; and "outer," "outer side," or the like refers to the side of the locking device that is farthest from the container 2 when the locking device 10 is mounted on the container 2. Between the inner plate 114 and the outer plate 106, from the center out, are the framing plates 108*a* and 108*b*, the blocking plates 110*a* and 110*b*, and the anchor plates 112*a* and 112*b*. Thus the framing plates 108*a* and 108*b* are located at the center and adjacent to each other; the blocking plate 110*a* is adjacent to the framing plate 108*a*; the blocking plate 110*b* is adjacent to the framing plate 108*b*; the anchor plate 112*a* is adjacent to the blocking plate 110*a*; and the anchor plate 112*b* is adjacent to the blocking plate 110*b*. Because the framing plates 108*a* and 108*b* are mirror images of each other, only one plate will be discussed in detail below. The same is also true of the blocking plates 110*a* and 110*b*, and the anchor plates 112*a* and 112*b*.

Figure 7:
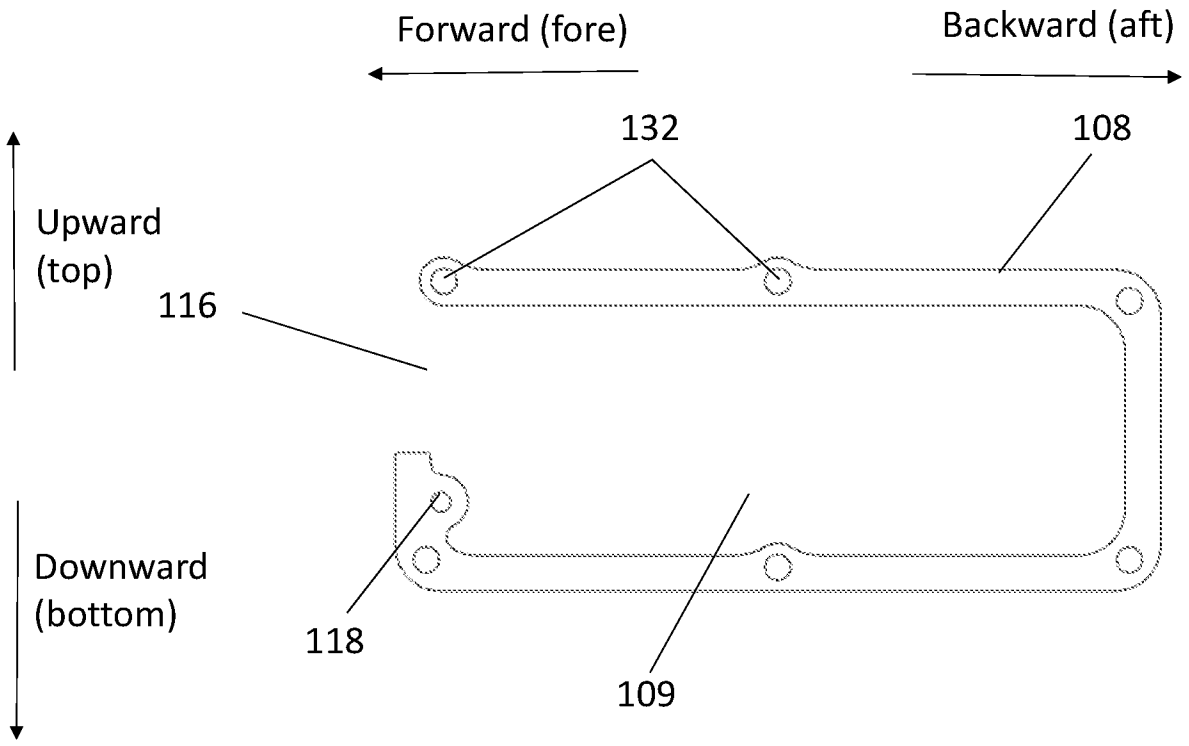
FIG. 7 is a side view of the framing plate.

FIG. 7 illustrates the details of the framing plate 108. The framing plate 108 has a hollow center 109, frames the perimeter of the housing 100, and contains a perimeter cutout portion 116. When assembled, the cutout portion 116 forms an opening to allow the sliding member 200 to protrude therethrough so that the neck portion 212 is located outside of the housing 100 (see FIG. 8). The opening formed by cutout portion 116 also allows a portion of the sliding member 200 to slide in and out of the housing 100 (compare FIGS. 8 and 14). The framing plate 108 also include a hole 118 for coupling of the biasing member 206 thereto. Thus, one end of the biasing member 206 is coupled to the hole 118 on the framing plate, while the other end of the biasing member 206 is coupled to the bottom shaft 222 or directly to the bottom portion of the pivot lever 204.

Figure 9:
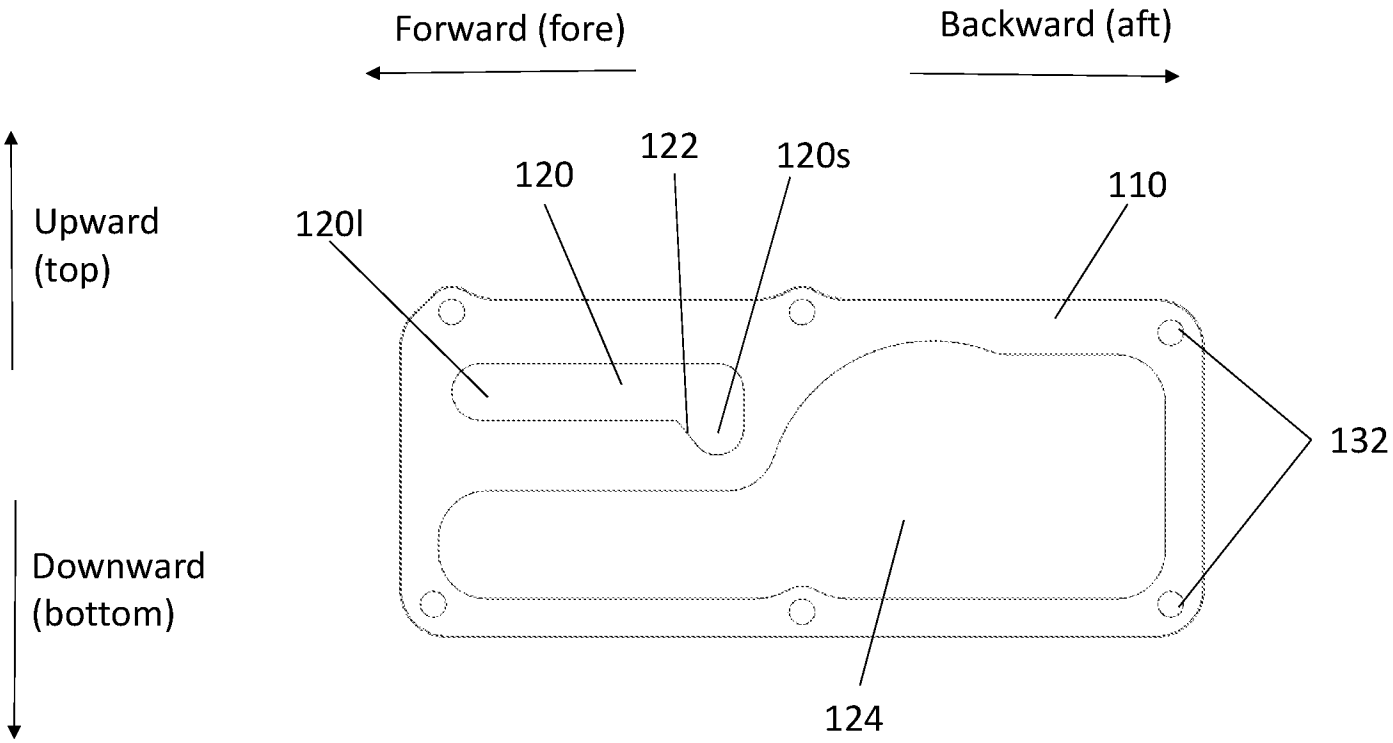
FIG. 9 is a side view of the blocking plate.

FIG. 9 illustrates the details of the blocking plate 110. The blocking plate 110 contains a L-shaped cutout 120. The cutout 120 contains a substantially horizontal long leg 120*l* and a substantially vertical short leg 120*s*. The short leg 120*s* contains an angled or slanted surface 122 matching the angle of the first slot 216 in the sliding member 200. When the locking device 10 is in its closed position and upright (as best shown in FIG. 8), the angled surface is in registry with the first slot 216. In that orientation, the rolling member 202 is in its blocked position (at the bottom of the first slot 216), such that the rolling member 202 spans the thickness of sliding member 200 and protrude into the blocking plate 110, and is lodged in the short leg 120*s* behind the angled surface 122 (as best illustrated in FIG. 8). In that position, the angled surface 122 and the rolling member 202 cooperate to block the sliding member 200 from sliding in the forward direction. The blocking plate 110 may also contain a large cutout 124 to accommodate parts of the locking mechanism, such as the biasing member 206 and the pivot lever(s) 204. The large cutout 124 also reduces the weight of the locking device 10.

Figure 10:
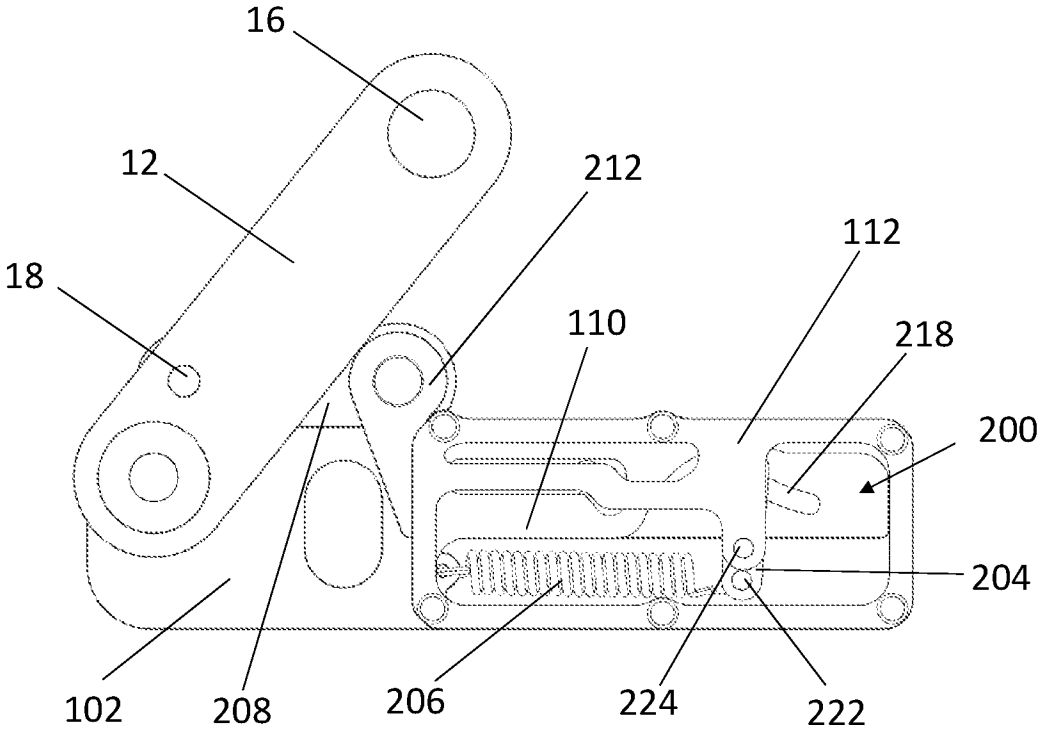
FIG. 10 is a side view of the locking device from the inner side (with the inner plate removed)
Figure 11:
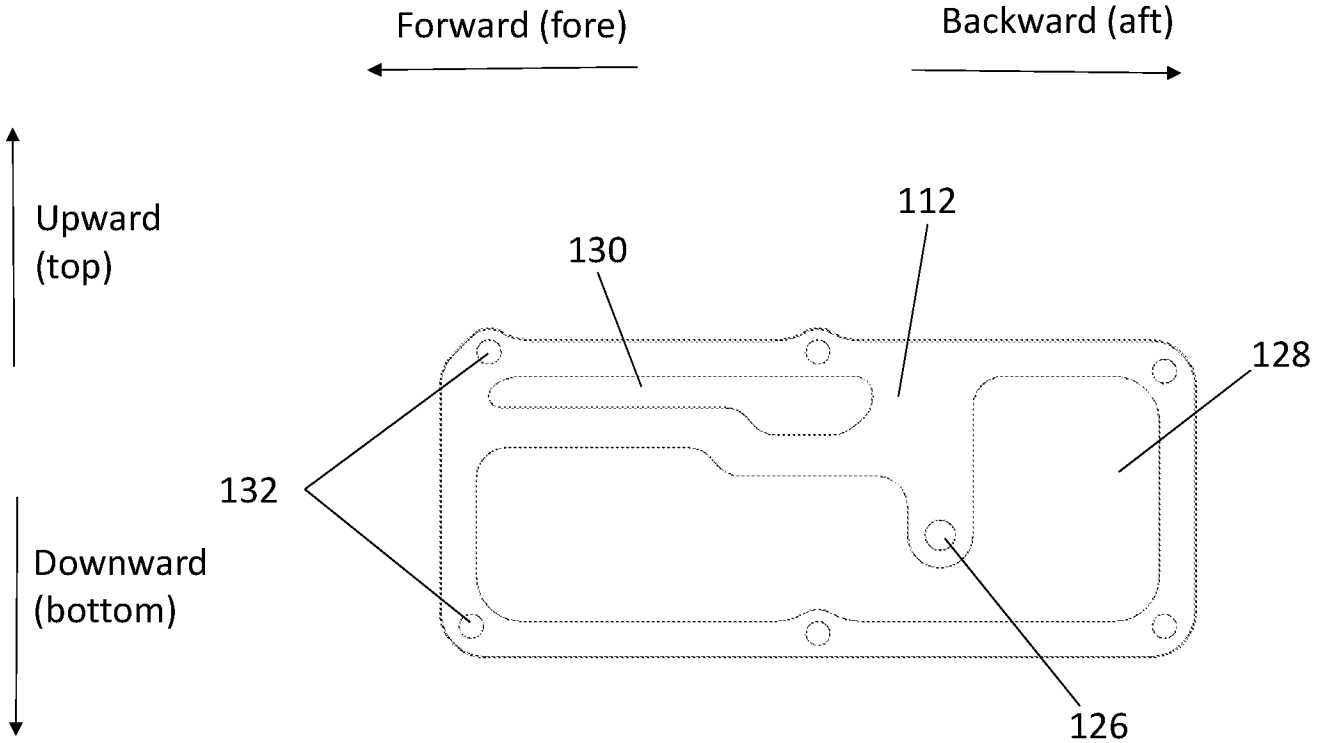
FIG. 11 is a side view of the anchor plate.

FIG. 11 illustrates the details of the anchor plate 112. The main function of the anchor plate 112 is to provide an anchor point for fixing the pivot shaft 224 to the housing 100. Accordingly, the anchor plate 122 preferably contains a hole 126 for anchoring one end of the pivot shaft 224 and to fix the pivot shaft 224 in place. The pivot shaft 224 passes approximately perpendicularly through the hole 126 and is retained therein, preferably by friction. The hole 126 fixes the pivot shaft 224 in place to allow the pivot lever 204 to pivot thereon. As shown in FIGS. 10-11, the anchor plate 112 may also have hollow cutouts 128 and 130. Those cutouts 128 and 130 reduce the overall weight of the locking device 10, but do not have a locking function.

Figure 12:
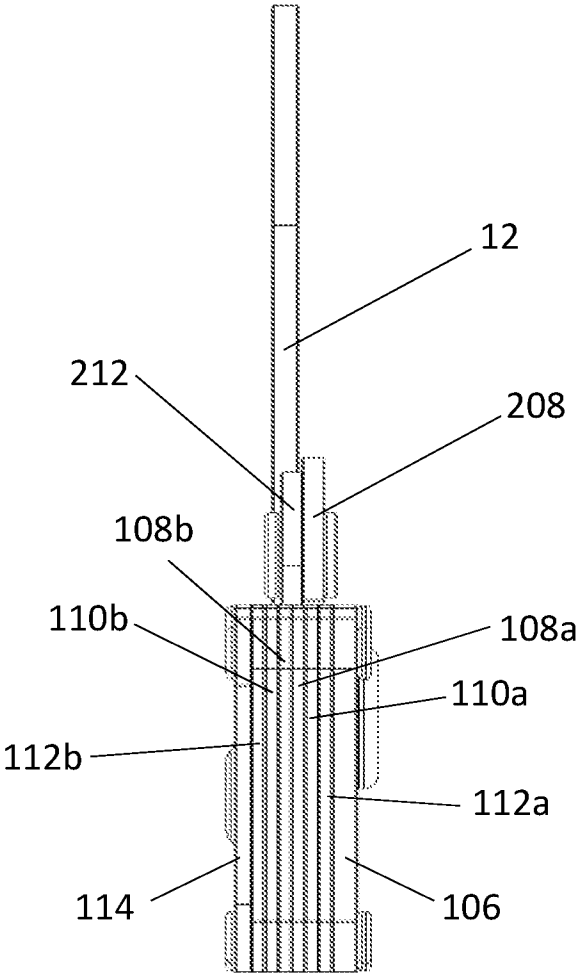
FIG. 12 is a rear view of the locking device showing the assembly of the plates.

Each of the plates preferably contains matching holes 132 for assembly of the housing by a fastener. For assembly, the plates are stacked so that matching holes 132 are aligned with each other; and fasteners, such as rivets, are inserted through the holes to secure the plates together. The order of the plates from the outer side to inner side, as best shown in FIG. 12, is as follows: outer plate 106, anchor plate 112*a*, blocking plate 110*a*, frame plate 108*a*, frame plate 108*b*, blocking plate 110*b*, anchor plate 112*b*, and inner plate 114. Essentially, the housing 100 contains two halves: 1) an inside half containing the framing plate 108*b*, the blocking plate 110*b*, the anchor plate 112*b*, and the inner plate 114; and 2) an outside half containing the framing plate 108*a*, the blocking plate 110*a*, the anchor plate 112*a*, and the outer plate 106. The two halves are assembled together to contain the locking mechanism therebetween. Although several plates are described herein as an exemplary embodiment, a skilled person in the art would recognize that the functions of two or more plates may be combined into a single plate. For example, the blocking plate 110 and the anchor plate 112 may be combined as a single plate, or the anchor plate 112 and the outer plate may be combined as single plate, or all the plates on one half of the lock may be combined so that the lock includes two assembled halves. The multiple plate design allows the locking device 10 to be assembled without welding and to reduce weight.

In use, to prevent unauthorized access to the interior of the container, a lock, such as a padlock, is placed through the hole 18 of the pivotable unit 12 and the hole 226 of the connecting member 208. When the lock is in place and the container 2 is in it upright position (FIG. 1), the pivotable unit 12 cannot be rotated away from the container to its opened position, because the rolling member 202 is in its blocking position at the bottom of the first slot 216 (FIG. 8). In that position, the rolling member 202 abuts against the angled surface 122 in the blocking plate 110, preventing the sliding member 200 from sliding forwardly. To manually open the container, the lock may be removed from holes 18 and 226 to disconnect the pivotable unit 12 from the locking mechanism, thereby allowing a user to manually rotate the pivotable unit 12 forward and away from the lid 4 to the opened position.

Figure 14:
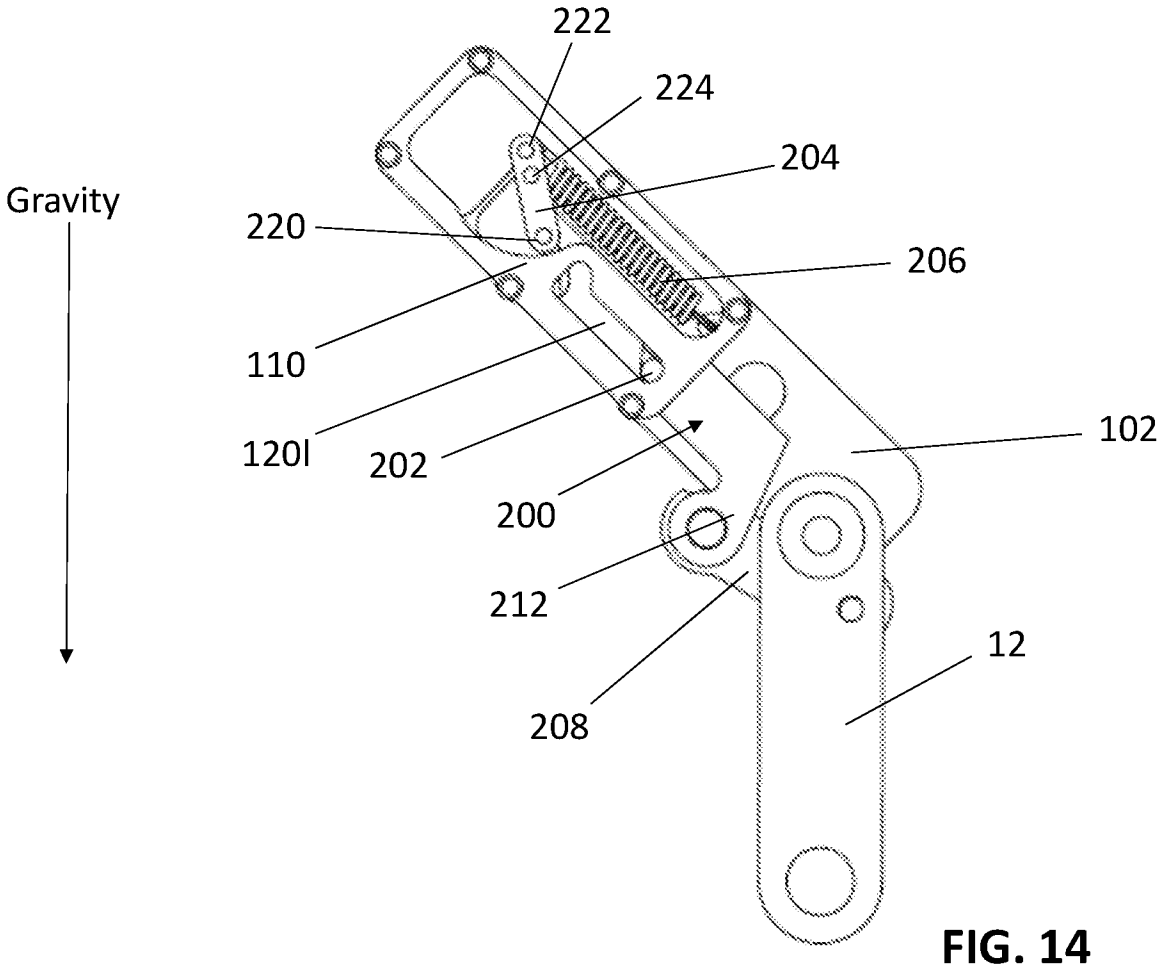
FIG. 14 is a side view of the locking device in the opened position from the inner side the (with the anchor and inner plates removed).

When it is desirable to remove the contents of the container 2 while the lock is in place, the container 2 may be grabbed by a lifting mechanism, e.g. of a waste collection truck (not shown), and moved from the upright position (FIG. 1) to the tilted or dumping position (FIG. 2). When in the upright position, the rolling member 202 is in the blocking position (as shown in FIG. 8). Accordingly, the pivotable unit 12 is prevented from pivoting to its open position. However, when the waste container 2 is tipped forward, gravity pulls the rolling member 202 from the blocking position (shown in FIG. 8) to the release position (shown in FIG. 13). In the release position, the rolling member 202 is freed from the angled surface 122 and no longer obstructs the forward displacement of the sliding member 200. Consequently, the pivotable unit 12 may pivot (by gravity on the pivotable unit 12 and the locking bar 6) to its open position, as shown in FIG. 14. The pivotable unit 12 may rotate by gravity from the closed position to the open position. As the pivotable unit 12 rotates forwardly, the sliding member 200, which is connected to the pivotable unit 12 via the connecting member 208 and the lock, is linearly displaced in the forward direction (as shown in FIG. 14). The lid 4 of the waste container 2 may then swing open by gravity, permitting the contents of the waste container 2 to be emptied. When the sliding member 200 slides forwardly, the pivot lever 204 pivots on the pivot shaft 224, allowing the top shaft 220 to slide within the second slot 218 toward the bottom end of the second slot 218 (FIG. 14). In that position, because of the a:b ratio, the biasing force puling on the pivot lever 204 (and thus the sliding member 200) is not sufficient to overcome the gravitational force on the pivotable unit 12. That way, as the waste stream is being emptied from the container 2, the pivotable unit 12 and the locking bar 6 are not pulled into that waste stream. When the container 2 is returned to its upright position, the biasing member 206 pulls sliding member 200 aft, by acting on the pivot lever 204, thereby pulling the pivotable unit into the closed position. In the upright, closed position, gravity pulls the rolling member 202 to its blocking position at the bottom of the first slot 216.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A locking device, comprising:

a) a sliding member containing a first slot angularly disposed therein and a second slot;

b) a rolling member disposed in the first slot;

c) a pivot lever;

d) a top shaft coupling a top portion of the pivot lever to the second slot by to the top portion of the pivot lever and passing through the second slot;

e) a pivot shaft fixed to a middle portion of the pivot lever; and f) a biasing member biasing a bottom portion of the pivot lever in a first direction.

2. The locking device of claim 1, further comprising a housing, wherein the sliding member is slidably mounted in the housing and protrudes through an opening in the housing.

3. The locking device of claim 2, wherein the sliding member comprises a neck portion positioned outside the housing and a main body position inside the housing.

4. The locking device of claim 3, wherein the second slot forms an upward crescent shaped and angularly disposed in the main body.

5. The locking device of claim 2, wherein the biasing member is a spring having a first end coupled to the housing and a second end coupled to the bottom portion of the pivot lever.

6. The locking device of claim 5, wherein a second end of the spring is coupled to the bottom portion of the pivot lever via a bottom shaft attached to the bottom portion of the pivot lever.

7. The locking device of claim 2, wherein the housing comprises several plates stacked together.

8. The locking device of claim 7, wherein the plates are stacked in the following sequential order inner plate, first anchor plate, first blocking plate, first framing plate, second framing plate, second blocking plate, second anchor plate, and outer plate.

9. The locking device of claim 8, wherein the first and second anchor plates are mirror images of each other, the first and second blocking plates are mirror images of each other, and the first and second framing plates are mirror images of each other.

10. The locking device of claim 9, wherein the each of the first and second framing plates comprises a hollow center, a perimeter cutout portion that form the opening in the housing when the plates are assembled, and a hole for coupling to the biasing member.

11. The locking device of claim 9, wherein each of the first and second framing plates contains a L-shaped cutout having contains a substantially horizontal long leg and a substantially vertical short leg, the short leg contains an angled surface in registry with the angle of the first slot on the sliding member, when the rolling member is positioned at the bottom of the first slot, it is in contact with the angled surface to block the sliding member from sliding relative to the housing.

12. The locking device of claim 9, wherein each of the first and second anchor plates contains a hole for fixing the pivot shaft to the housing.

13. The locking device of claim 8, wherein the plates are held together by rivets, screws, or nuts and bolts.

14. The locking device of claim 1, wherein the pivot shaft supports a bottom of the sliding member to allow the sliding member to slide thereon.

15. The locking device of claim 1, wherein the distance between the top portion of the pivot lever to the middle portion of the pivot lever is greater than the distance between the bottom portion of the pivot lever to the middle portion of the pivot lever.

16. The locking device of claim 15, wherein the ratio of the distance between the top portion of the pivot lever to the middle portion to the distance between the bottom portion of the pivot lever to the middle portion of the pivot lever is about 1.3:1 to about 5:1.

17. The locking device of claim 1, wherein when the rolling member is positioned at a bottom portion of the first slot, the sliding member is blocked from sliding forwardly.

18. The locking device of claim 1, further comprising a pivotable unit and a connecting member, wherein the connecting member is configured to couple the sliding member to the pivotable unit with a lock.

19. The locking device of claim 18, wherein the connecting member is a plate or a rod.

20. The locking device of claim 18, wherein a first end of the connecting member is rotatably coupled to the neck portion of the sliding member and a second end of the connecting member is configured to couple to the pivotable unit with a lock.

21. A container assembly, comprising:

a) a container body;

b) a hinged lid pivotally mounted to the body; and c) the locking device of claim 1 mounted on the container body.

22. The container assembly of claim 21, further comprising a) a support member mounted to the container body opposing the locking device;

b) a pivoting arm pivotally mounted to the support member; and c) a locking bar having a first end fixed to the pivotable unit and a second end fixed to the pivoting arm, wherein when the pivoting unit is in the closed position, the locking bar is positioned over the hinged lid to prevent access to the container body, and when the pivoting unit is in the open position, the locking bar is spaced away from the lid to allow opening of the container.

23. The container assembly of claim 22, wherein the locking bar is fixed to an end of the pivotable unit so as to extend approximately perpendicularly to the plane of the pivotable unit.

24. A method for making a waste container comprising the steps of d) providing a container having a hinged lid pivotally mounted to the body; and a) mounting the locking device of claim 1 to the container body.

* * * * *